United States Patent [19]

Tzu-Yen

[11] 4,176,740

[45] Dec. 4, 1979

[54] AUTOMATICALLY STAMPING MAILBOX

[76] Inventor: Hsieh Tzu-Yen, No. 8-2, Alley 36, Lane 31, Yu Ying St. Ching Mei Town,, Taipei, Taiwan

[21] Appl. No.: 826,744

[22] Filed: Aug. 22, 1977

[51] Int. Cl.[2] ..... G07F 17/12

[52] U.S. Cl. ..... 194/9 R; 194/DIG. 8

[58] Field of Search ..... 194/DIG. 8, 10, 4 R, 194/9 R

[56] References Cited

U.S. PATENT DOCUMENTS 2,170,270 8/1939 Thatcher ..... 194/DIG. 8

*Primary Examiner*—Stanley H. Tollberg

*Attorney, Agent, or Firm*—Holman & Stern

[57] ABSTRACT

An automatic coin-operated stamping mailbox having a coin collector which activates a first switch. A letter to be mailed is inserted into a slot which activates a second switch in series with the first thereby operating a motor driving a set of rollers which mark the letter. A third switch following the rollers keeps the motor going until the letter clears the rollers and drops into a letter cabinet. A gear system coupled with the coin controller deactivates the first switch; since the second and third switches are normally open, the motor shuts down as soon as the letter clears.

3 Claims, 13 Drawing Figures

AUTOMATICALLY STAMPING MAILBOX

BRIEF SUMMARY OF THE INVENTION

A specially designed mailbox with a few slots on the front face of the box can be erected on the streets. The smaller slots are designed for coins while the bigger ones for letters. A certain amount of coin(s) is (are) inserted into the small slot first, then the letter to be mailed without stamp on it is inserted into the big slot. The coin(s) will be identified first, so that an uncorrect coin will be picked out. Through a set of gears and rollers, the letter will be stamped. If the inserted coin(s) is (are) correct one(s) and at adequate value. The letter is then duly mailed.

FIGS. *6a, 6b, 6c,* and 7 show the progression of an inserted coin through the coin controller.

Figure 8:
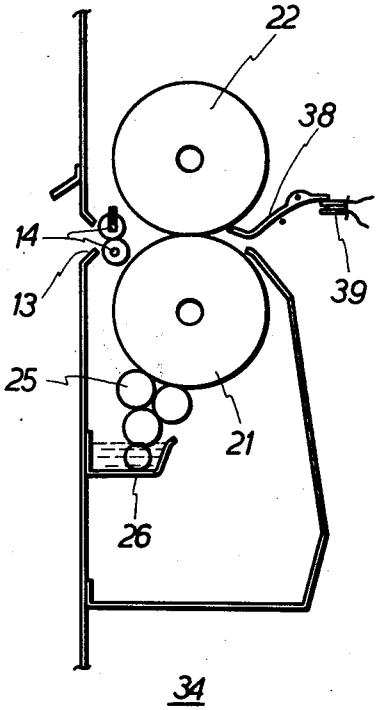

FIG. 8 is the side view of the letter receiver.

Figure 9:
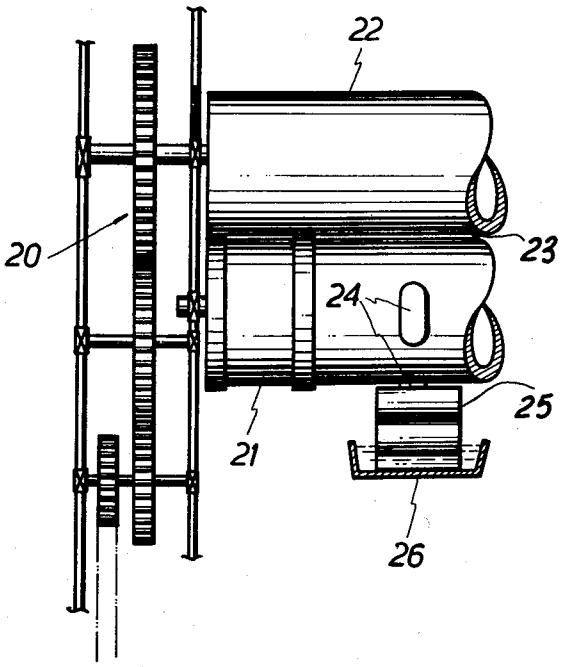

FIG. 9 is the front view of the letter receiver.

Figure 10:
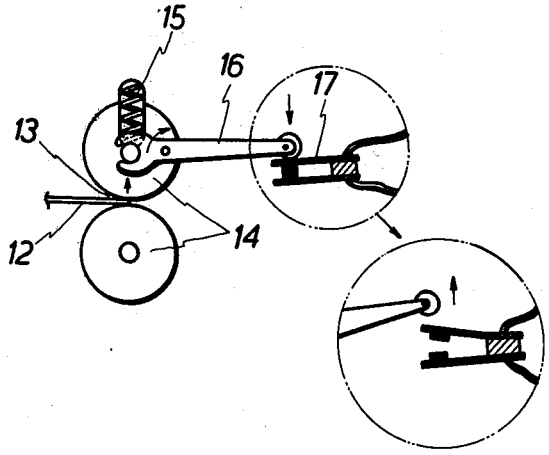

FIG. 10 shows the letter receiver switch.

Figure 11:
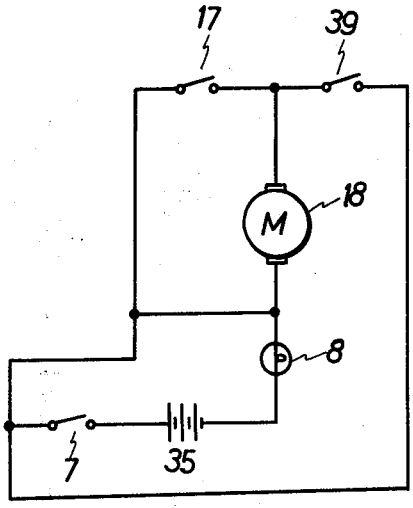

FIG. 11 is the circuit diagram of the present invention.

DETAILED DESCRIPTION

Figure 1:
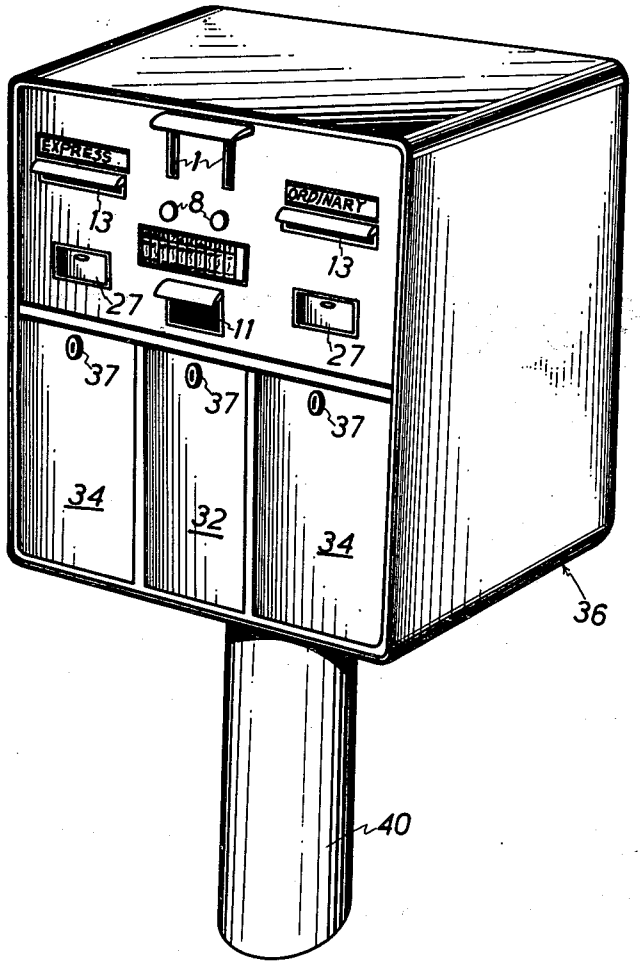
FIG. 1 is the perspective view of the embodiment of the present invention.

FIG. 1 shows the outer appearance of the whole invention.

Figure 4:
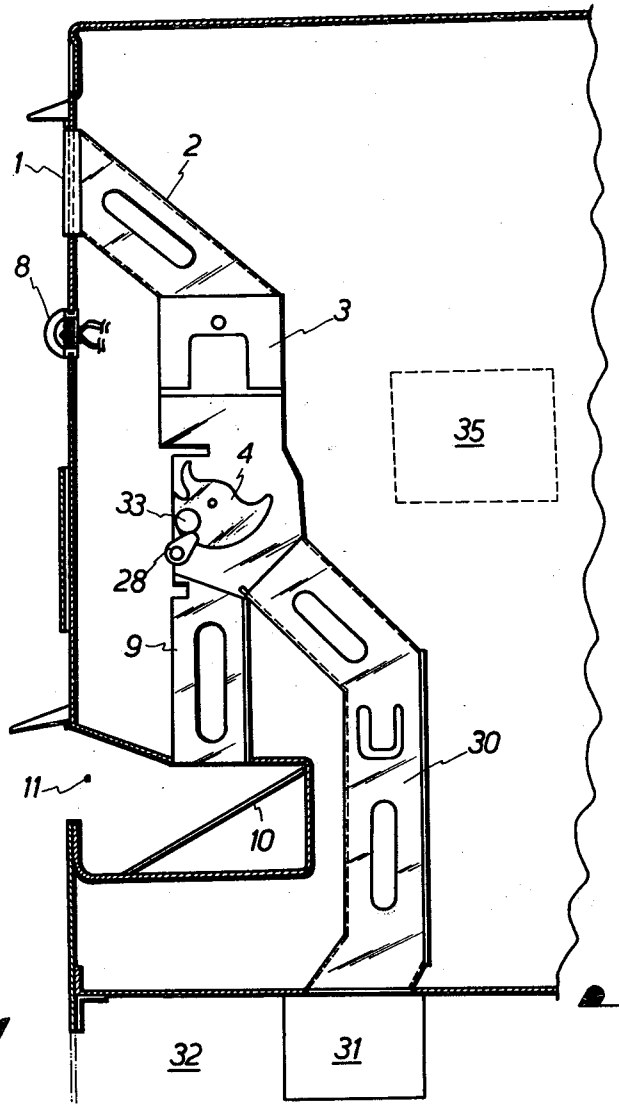
FIG. 4 is the side view of the coin receiver.

When a coin is inserted into the coin slot 1, it rolls down a coin path 2 to a coin selector 3. The coin selector is an already-made commercial product, so it needn't be described any further. If the coin is a correct one, it will fall down onto a coin controller 4. By the impact force and the weight of the inserted coin(s), the coin controller 4 will turn at a certain angle with the coin still on it, see FIGS. 4, *6a, 6b, 6c.* The coin controller 4 is on one end of a pivot 5 having a cam 6 on its other end. The cam 6 turns at a certain angle while the coin controller turns. The cam 6 activates spring switch 7 turning. The circuit is closed and a pilot lamp 8 lights. This shows a user that this mailbox is now ready to receive a letter to be mailed and stamped, see FIGS. 7 and 1.

If the inserted coin is an uncorrect one, when it passes the coin selector 3, it will be picked out and rolls down to another path 9. It will finally rest on an inclined plate 10 to be taken out from an opening 11, see FIG. 4.

In FIG. 10, it is clear that when a letter 12 is inserted into the slot 13, a small roller 14 is forced to move upward against a spring 15. Then a lever 16 rotates downward at its right end to make a switch 17 turn on. The enlarged figure in FIG. 10 shows the switch 17 in off position. A motor 18 is started when the switch 17 is turned on by the inserted letter 12.

FIG. 11 shows the whole current circuit of the present invention. It is only a simple one, so that a fewer breakdowns will take place. Numeral 35 designates a set of batteries or the A.C. Power source.

Figure 5:
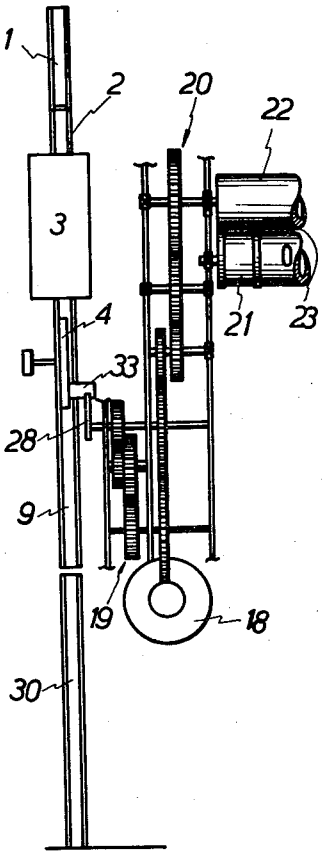
FIG. 5 is the front partially sectioned view of the coin receiver.

FIG. 5 shows two gears systems 19 and 20 driven by the motor 18. A press roller 21 and a counter press roller 22 are connected to the gear system 20 directly and turn in the opposite way, so that the inserted letter 12 can pass through a slit 23 between the two rollers 21 and 22 and can be pressed or stamped by a carved stamp 24 which is already prepared on the roller 21. The figure of the stamp can be in any form as desired, for example, a real carved stamp or only a certain carved mark, see FIG. 9.

The carved stamp 24 can be inked by a set of ink rollers 25 which are supplied with ink from an ink reservoir 26, as shown in FIG. 8. The set of ink rollers 25 is so designed that the ink from the ink reservoir 26 can be spreaded homogeneously on the ink rollers 25 and on the carved stamp 24. The ink can be filled through an ink filling slot 27, as shown in FIG. 1.

Figure 3:
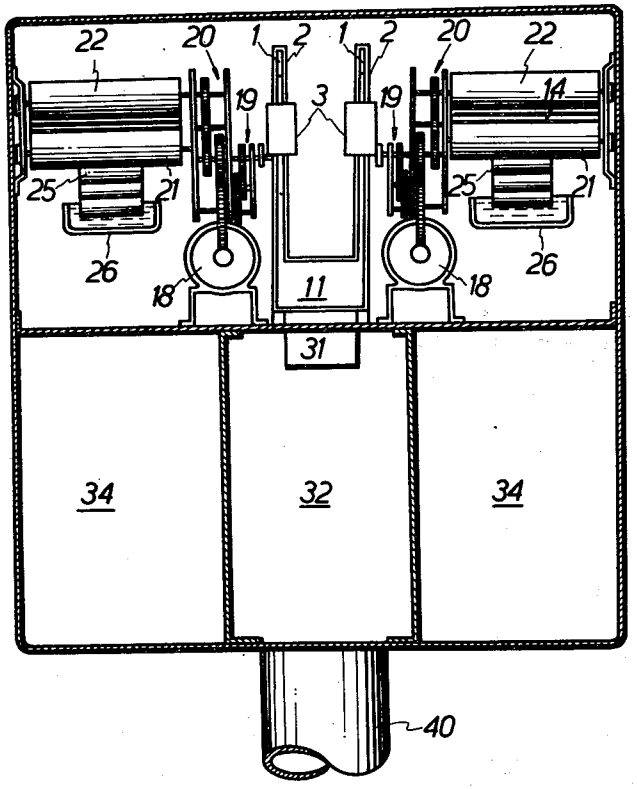
FIG. 3 is the front view of the embodiment with the front cover moved.
Figure 6A:
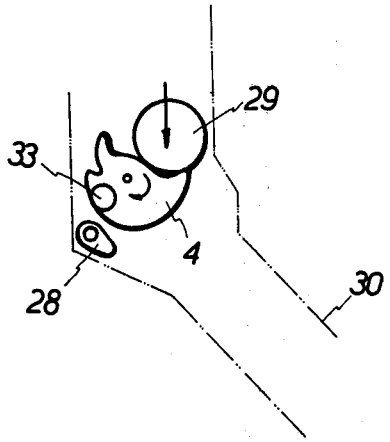
Figure 6B:
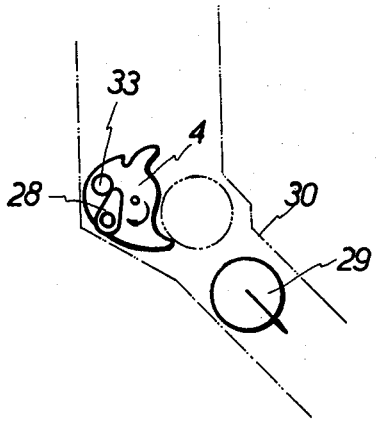
Figure 6C:
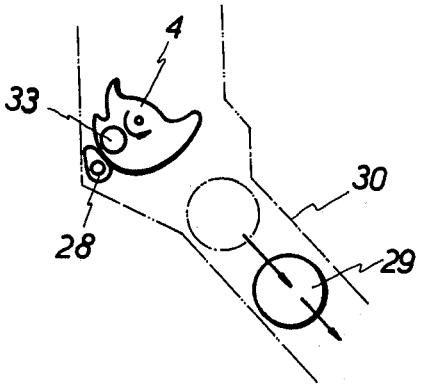
Figure 7:
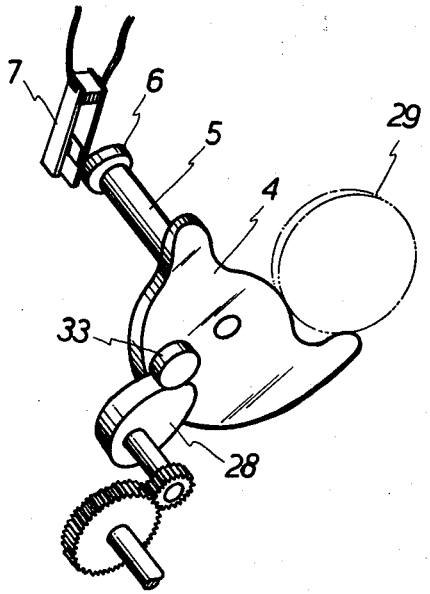

A cam 28 mounted on gear system 19 rotates when the gear system 19 is driven to turn by the motor 18, as shown in FIGS. 5, *6a, 6b, 6c* and 7. When the tip of the cam 28 moves upward, the coin controller 4 is forced to rotate clockwise to the upmost position letting the inserted coin 29 fall down a coin path 30. After passing through a counter 31, the inserted coin 29 is counted and falls down into a coin cabinet 32, as shown in FIGS. 1 and 3. The coin controller 4 returns to its original position by the action of the counter weight 33 after the inserted coin 29 leaves the controller 4. The counter weight 33 is also used as a pin against the cam 28. When the coin controller 4 returns to its original position, the cam 6 also rests in its original position with the spring switch 7 open, as shown in FIG. 7.

The counter 31 is also an already-make commercial product, so no further description about it is needed here.

When the inserted letter 12 is moved in by the two rolling rollers 21 and 22, it pushes the lower end of a lever 38 upward with the upper end downward to press a spring switch 39 on, as shown in FIG. 8. At this moment, the inserted coin 29 falls down to the coin cabinet 32, thus the spring switch 7 is off first. After the inserted letter 12 has passed the lower end of the lever 38, the pressure force will be released from the upper end of the lever 38, so the spring switch 39 returns to the off position. The pilot lamp 8 will be off and the motor 18 will stop, as shown in FIG. 11. Now the whole mailbox 36 is ready for the next coin and letter to be inserted.

After having been printed, the inserted letter 12 falls down into a letter cabinet 34, as shown in FIGS. 1 and 8.

Figure 2:
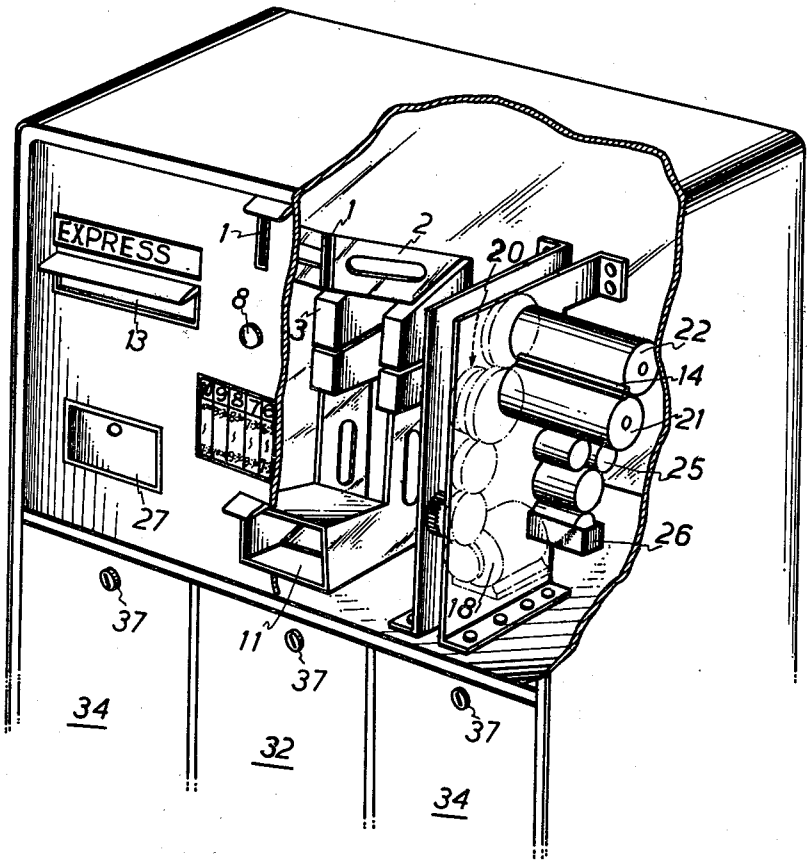
FIG. 2 is the perspective view of the rollers and other devices inside the box.

FIG. 2 clearly shows the arrangement of the printing and inking rollers.

There is a stand 40 to support the whole box 36, as shown in FIG. 1.

Three locks 37 are prepared for two letter cabinets 34 and one coin cabinet 32, as also shown in FIG. 1.

FIG. 1 shows a box with two vertical coin slots 1, two horizontal letter slots 13, etc, designed for two classes of mails ORDINARY and EXPRESS can be written on the box above the letter slots 13, as shown in FIG. 1.

I claim:

1. An automatic coin-operated stamping mailbox comprising:

a casing having a coin slot, a letter slot, a coin return opening, a letter cabinet and a coin cabinet;

a coin selector;

a coin collector;

a coin counter, said selector, collector and counter being mounted in said casing and forming a correct coin path between said coin slot and said coin cabinet, said coin collector comprising a coin controller pivotally arranged in said coin path to be turned to a certain angle by the impact force and weight of a coin, a cam operatively connected to said controller to be turned thereby, and a first normally open spring-loaded electrical switch operatively associated with said cam being closed when said cam is rotated by said controller;

an electrical power source in said casing;

a pilot light, said source and said light being in a first electrical loop with said first switch;

a pair of rollers aligned in parallel with said letter slot in said casing, one of said rollers having a carved stamp mark thereon, said rollers defining a letter path between said letter slot and said letter cabinet;

inking rollers inkingly associated with said pair of rollers to ink said stamp mark;

a second normally open spring-loaded electrical switch mounted before said rollers in said letter path;

a third normally open spring-loaded electrical switch mounted after said rollers in said letter path;

an electrical motor mounted in said casing, said motor being in a second electrical loop with said second switch which includes said source, said light and said first switch and said motor also being in a third electrical loop with said source, said light, and said third switch;

a first gear system mechanically connecting said motor and said pair of rollers to rotate the same; and a second gear system operatively connecting said motor to said coin controller, whereby when a correct coin is inserted through said coin slot, said coin controller is turned closing said first switch lighting said light, thereafter when a letter is inserted through said letter slot said second switch is closed starting said motor turning said pair of rollers marking the letter, as the letter is marked said third switch is closed, said second gear system permits the coin to continue to said coin cabinet, said third switch opening and stopping said motor only after the letter clears said rollers dropping into said letter cabinet.

2. The mailbox of claim 1, wherein said second switch comprises a pair of receiving rollers contacting each other, each having an axis aligned parallel to said letter slot, said rollers being freely rotatable, one of said receiving rollers being movable perpendicular to its axis; a lever having one end operatively connected to said movable receiving roller; a spring biasing said movable receiving roller into contact with the other roller; and a normally open leaf spring mechanically associated with the other end of said lever whereby when a letter is pushed between said receiving rollers, said movable roller operates said lever closing said leaf spring.

3. The mailbox of claim 1 wherein said coin controller includes a counterweight pin and said second gear system comprises a cam mechanically associated with said pin for turning said controller from said certain angle whereby the coin is released from said controller, said counterweight pin returning said controlled to its normal position thereby opening said first switch.

* * * * *